US009416758B2

(12) United States Patent
Myers et al.

(10) Patent No.: US 9,416,758 B2
(45) Date of Patent: Aug. 16, 2016

(54) FUEL FILTER

(71) Applicant: Ford Global Technologies, LLC, Dearborn, MI (US)

(72) Inventors: Eric Myers, Howell, MI (US); Paul Victor Budgen, Maldon (GB)

(73) Assignee: Ford Global Technologies, LLC, Dearborn, MI (US)

( * ) Notice: Subject to any disclaimer, the term of this patent is extended or adjusted under 35 U.S.C. 154(b) by 908 days.

(21) Appl. No.: 13/725,103

(22) Filed: Dec. 21, 2012

(65) Prior Publication Data

US 2014/0174410 A1 Jun. 26, 2014

(51) Int. Cl.
*F02M 37/22* (2006.01)
*F02M 33/08* (2006.01)
*F02M 37/00* (2006.01)

(52) U.S. Cl.
CPC ..... *F02M 37/22* (2013.01); *F02M 33/08* (2013.01); *F02M 37/0035* (2013.01); *F02M 37/221* (2013.01)

(58) Field of Classification Search
CPC . F02M 37/22; F02M 37/221; F02M 37/0035; F02M 33/08
USPC ..... 123/514; 210/196, 149, 181
See application file for complete search history.

(56) References Cited

U.S. PATENT DOCUMENTS 4,387,691 A 6/1983 Marcoux et al.
4,501,255 A 2/1985 Van Der Ploeg et al.
4,901,265 A 2/1990 Kerr et al.
5,904,844 A 5/1999 Stone
6,527,947 B1 * 3/2003 Channing ..... F02D 33/006 123/514
6,860,241 B2 3/2005 Martin et al.
7,922,004 B2 4/2011 Matsushita et al.
8,038,872 B2 10/2011 Jokschas et al.
8,079,479 B2 12/2011 Leppert
8,110,102 B2 2/2012 Fay
8,114,278 B2 2/2012 Lorente et al.
8,136,511 B2 3/2012 Cushing
8,173,013 B2 5/2012 Sato et al.
2003/0116490 A1 * 6/2003 Keyster ..... B01D 35/18 210/184
2007/0062494 A1 * 3/2007 Yanagi ..... B01D 35/147 123/514
2011/0036770 A1 2/2011 Jokschas et al.
2013/0001176 A1 * 1/2013 Wells ..... B01D 35/30 210/806
2014/0000727 A1 * 1/2014 Fisher ..... F02M 37/0052 137/468

FOREIGN PATENT DOCUMENTS

WO WO 0206662 A1 * 1/2002 ..... B01D 29/21

* cited by examiner

*Primary Examiner* — Hieu T Vo
*Assistant Examiner* — Arnold Castro
(74) *Attorney, Agent, or Firm* — James Dottavio; Alleman Hall McCoy Russell & Tuttle LLP

(57) ABSTRACT

Embodiments may provide a fuel filter that may include a plurality of return fuel conduits axially traversing a filter medium. Each conduit may include an inlet in fluidic communication with the fuel recirculation passage. Each conduit may have a return fuel line exit port adjacent to a distal end of the filter medium.

19 Claims, 5 Drawing Sheets

FUEL FILTER

FIELD

The present application relates to devices and systems for conditioning the fuel of a diesel engine, including a fuel filter and a system wherein fuel flows of differing characteristics are directed to traverse a filter medium before mixing and passing through the filter medium.

BACKGROUND

Engines may be configured to operate using diesel fuels. There is typically, at least one fuel filter arranged in the fuel system to filter out particles which may be in the diesel fuel. A common issue with diesel fuel filters, in particular at low ambient temperatures, such as during an engine cold-start, is that wax may precipitate out of the diesel fuel. The precipitated wax may clog the fuel filter. The amount of wax that precipitates from the fuel may depend upon the fuel properties and ambient temperature the vehicle is started in. As such, the precipitated wax in the fuel may reduce the pressure of the fuel system, performance of the engine and, if severe enough, can cause damage to the fuel system.

Techniques to mitigate problems associated with precipitated wax clogging diesel fuel filters generally fall into one of two categories. One is to include a heating mechanism with the filter. Another is to recirculate some fuel warmed by the engine through the filter via a recirculation line. Both techniques have shortcomings, but approaches to mitigate diesel fuel filter clogging have mostly been limited to including a heating mechanism with the filter.

One example approach to providing a heating mechanism with the filter is disclosed in US Patent Publication 2003/0116490. The disclosure provides a heater element positioned between an annular outer surface of the filter assembly housing and the fuel filter. Fuel traveling through the fuel filter is heated by the heater element when the fuel temperature is below a predetermined temperature.

The inventors herein have recognized several issues with this approach. For example, the addition of a heating element to the filter may add cost and complexity. Another shortcoming with this approach is, like many similar approaches, it fails to address several shortcomings with the technique of recirculating fuel warmed by the engine back through the filter. The inventors herein have recognized that the warm return fuel from the engine tends to remains near the top of the filter and does not distribute to the lower portion. In effect, the warm fuel does not perform the function it is intended. Embodiments in accordance with the present disclosure address this shortcoming.

Embodiments may provide a fuel filter that may include a plurality of return fuel conduits axially traversing a filter medium. Each conduit may include an inlet in fluidic communication with the fuel recirculation passage. Each conduit may have a return fuel line exit port adjacent to a distal end of the filter medium. In this way, it is possible to provide better thermal management via the fuel filter. For example, by operating via a method that flows heated fuel down the length of the filter through sealed tubes, it is possible to heat a greater amount of the filter to reduce fuel gelling during cold starts, such as with regard to diesel fueled vehicles.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
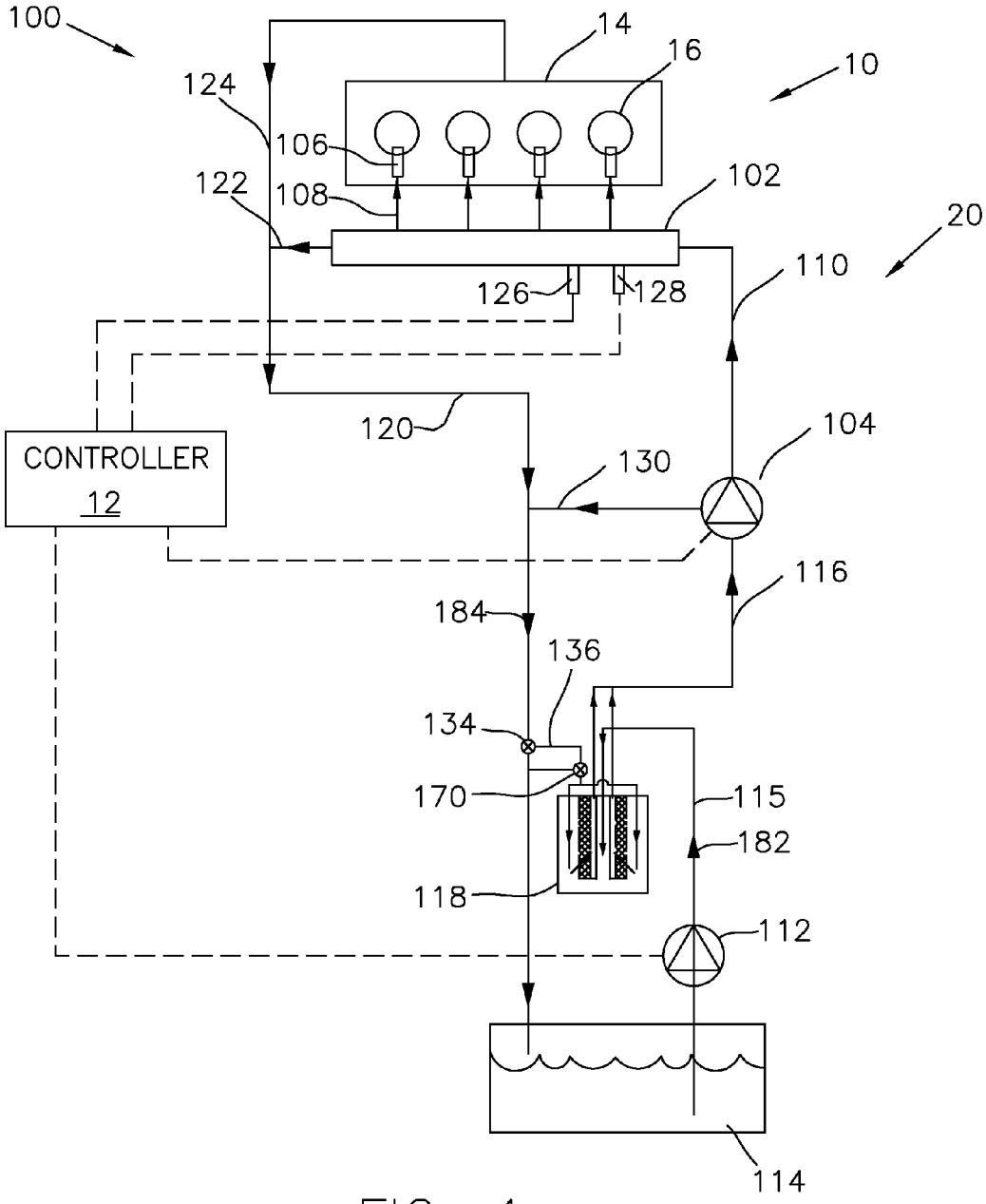
FIG. 1 shows an example vehicle system layout, including details of a fuel system.

The following description relates to systems and methods for diesel fuel conditioning. FIG. 1 depicts an example vehicle system 100. In the depicted embodiment, vehicle system 100 is a diesel-fuelled vehicle system. The driving force of the vehicle system 100 may be generated by engine 10. Engine 10 may include one or two banks 14. One bank 14 is indicated in the current example showing four cylinders 16. While engine 10 is shown as a 4-cylinder, four-stroke engine, it will be appreciated that the engine may have a different cylinder configuration (for e.g., in-line, V-shaped, or opposed) and/or a different number of cylinders (e.g., six, or eight).

Engine 10 of the vehicle system 100 may include a fuel system 20. Fuel system 20 may include a fuel rail 102, a supply pump 104, and fuel injectors 106. Fuel rail 102 may provide a chamber for holding fuel for subsequent injection into cylinders 16 through fuel injectors 106. In the depicted example, the fuel rail 102 may provide pressurized fuel to fuel injectors 106 of the bank 14 along high-pressure injector passages 108. Fuel rail 102 may include one or more fuel rail pressure sensors/switches 126 for sensing fuel rail pressures ($P_{fuel_rail}$) and one or more fuel rail temperature sensors 128 for sensing fuel rail temperatures ($T_{fuel_rail}$) and communicating the same with an engine controller 12. Only one fuel rail pressure sensor/switch 126 and one fuel rail temperature sensor 128 is shown for simplicity. Additional fuel rail pressure regulators may also be included. In the depicted example, fuel injectors 106 may be of the direct injection type, although it will be appreciated that they may alternately be of the port injection type. Further still, each cylinder 16 may include more than one injector, some of the injectors being of the direct injection type while others are of the port injection type.

Fuel may be pressurized by supply pump 104 and transferred to the fuel rail 102 along high-pressure rail passage 110. In one example, supply pump 104 may be driven by the rotation of engine 10, such as by an engine crankshaft and/or an engine camshaft. Alternatively, supply pump 104 may be driven by an optional electric motor.

A low pressure feed pump 112 may be configured to draw low-pressure fuel from fuel tank 114 via fuel inlet line 115, to pump it to and through fuel filter 118, and to the supply pump 104 via fuel outlet line 116. The fuel may move through the fuel filter 118 due to the pumping action of one or both of the low pressure feed pump 112 and the supply pump 104. As such, the fuel supplied to the supply pump, via the fuel filter 118, may hereinafter also be referred to as the supply fuel.

Fuel rail 102 may also be configured to return fuel, and thereby reduce fuel pressure, into low pressure recirculation passage 120 via rail return flow passage 122. A pressure reducing valve at the rail outlet (not shown) may regulate the return flow of fuel from the fuel rail into recirculation passage 120. Similarly, fuel returned from injectors 106 may also be fed into recirculation passage 120 via injector return flow passage 124. Supply pump 104 may also be configured to return fuel, and thereby reduce fuel pressure into recirculation passage 120 via pump return flow passage 130. A pressure reducing valve at the pump's outlet (not shown) may regulate the return flow of fuel from the supply pump into the recirculation passage 120. As such, the fuel returned from the supply pump, injectors, and/or rail may hereinafter also be referred to as the return fuel. The return fuel may be heated by one or more engine components, for example the bank 14 of cylinders 16, or the fuel rail 102 and consequently be at a higher temperature than the supply fuel. The fuel recirculation passage 120 may include a return fuel line 136 coupled with the fuel recirculation passage 120 wherein the warmed return fuel is able to be directed through the fuel filter 118. A fuel recirculation valve 134 may be configured to selectively direct selected amounts of the return fuel to the fuel filter 118.

Figure 2:
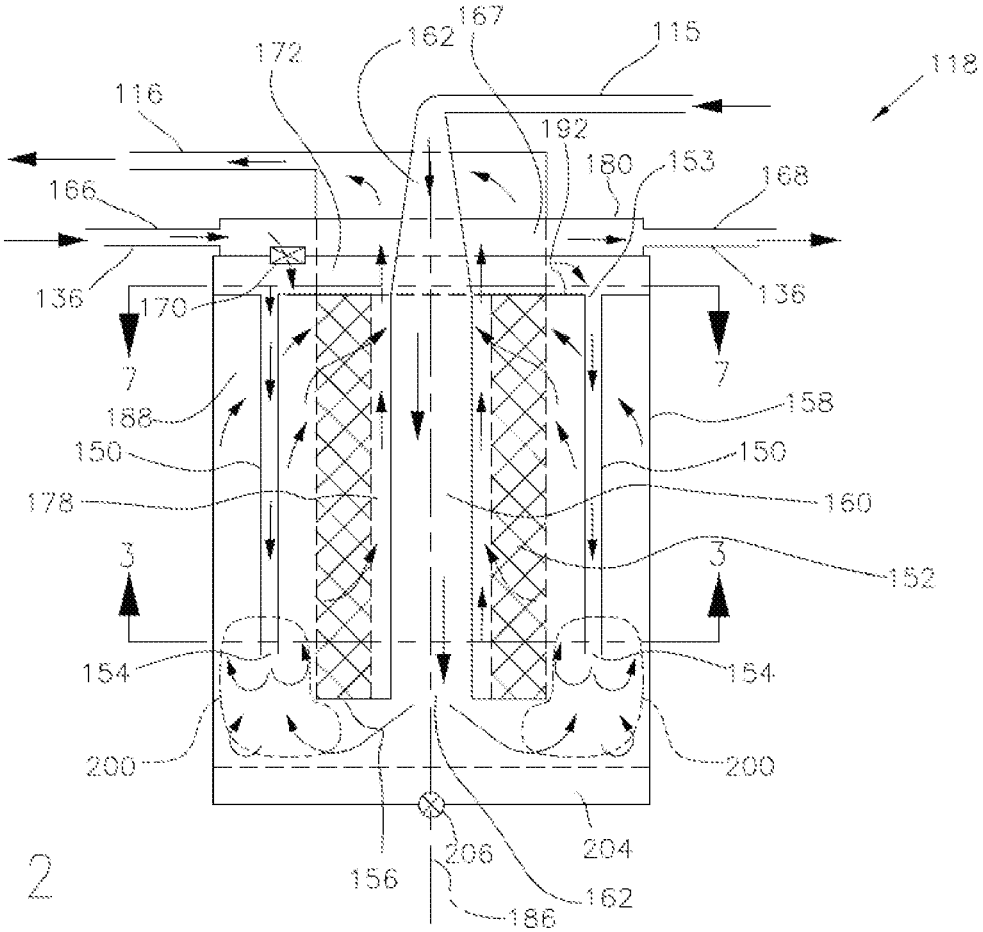
FIG. 2 is a sectional view illustrating selected details of a fuel filter in accordance with the present disclosure.

FIG. 2 is a sectional view illustrating selected details of an example fuel filter 118 in accordance with the present disclosure. The fuel filter 118 may be used in the system 100 illustrated in FIG. 1. The fuel filter 118 may include a plurality of return fuel conduits 150 axially traversing a filter medium 152. Each conduit 150 may include an inlet 153 in fluidic communication with the fuel recirculation passage 120 via, for example the return fuel line 136. In some embodiments each conduit 150 may be in direct fluidic communication with the fuel recirculation passage 120. Various examples may, or may not include the fuel recirculation valve 134. Each conduit 150 may have a return fuel line exit port 154 adjacent to a distal end 156 of the filter medium 152. Each conduit 150 may have a cross section of any number shapes, for example circular, oval, semicircular, rectangular, etc.

The fuel filter 118 may include a container 158 for housing the filter medium 152. There may be a fuel line conduit 160 axially traversing the filter medium 152. The fuel line conduit 160 may include an inlet 162 in fluidic communication with the fuel inlet line 115. The fuel line conduit 160 may also include a fuel line exit port 162 in fluidic communication with the plurality of return fuel line exit ports 154 to at least partially mix respective flows from the plurality of return fuel conduits 150 and the fuel line conduit 160 within the container 158 adjacent the distal end 156 of the filter medium 152. In this way, more effective mixing of the supply fuel with the heated return fuel within the fuel filter 118 may be achieved. In this way, the fuel filter wax removal at the filter may be expedited and potential issues related to wax build-up at the filter medium 152 may be better addressed.

In some embodiments the return fuel line 136 may include an inlet coupling 166 and an outlet coupling 168. The fuel filter 118 may include a volume 167 between the inlet coupling 166 and an outlet coupling 168. The volume 167 may be various shapes, for example an elongated volume, or an annular shape. A temperature sensitive valve 170 may be operatively disposed between the inlet coupling 166 and the outlet coupling 168 and may be configured to direct at least part of a flow from the return fuel line 136 to the plurality of return fuel conduits 150 when a temperature of the flow is within a preselected range. In this way, in addition to, or instead of the fuel recirculation valve 134 described above which may selectively direct various amounts of the return fuel to the fuel filter 118, additional control, or alternate control which may depend of the temperature of the return fuel may be achieved. Such control may, or may not, be operatively coupled with the controller 12.

Embodiments may include a manifold 172 formed within the container 158 to receive the flow from the return fuel line 136 via the temperature sensitive valve 170 when the temperature of the flow is within the preselected range. The plurality of return fuel conduits 150 may be fluidically coupled with the manifold 172. Some example embodiments may include two or more temperature sensitive valves 170 to control flow from the volume 167 and the manifold 172.

Figure 3:
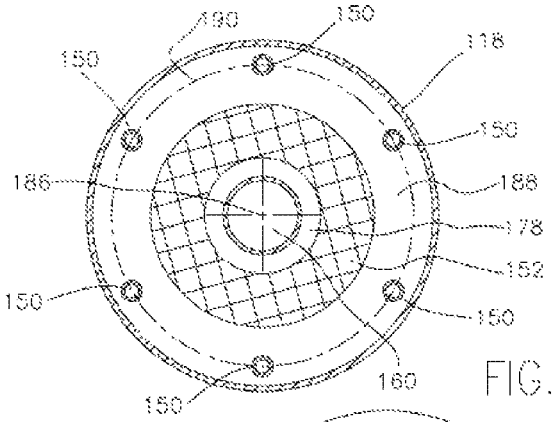
FIG. 3 is a sectional view taken at the line 3-3 of FIG. 2.
Figure 4:
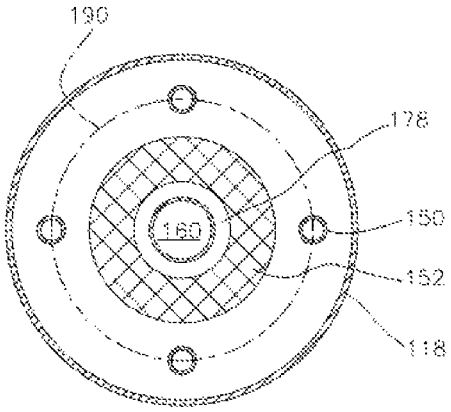
FIG. 4 is a sectional view similar to the view shown in FIG. 3 but illustrating selected details of another example fuel filter in accordance with the present disclosure.

FIG. 3 is a sectional view taken at the line 3-3 of FIG. 2. The figure illustrates an example wherein the plurality of return fuel conduits 150 may be six conduits 150. FIG. 4 is a sectional view showing another example embodiment having four return fuel conduits 150. Various other embodiments may have various numbers of return fuel conduits.

Figure 5:
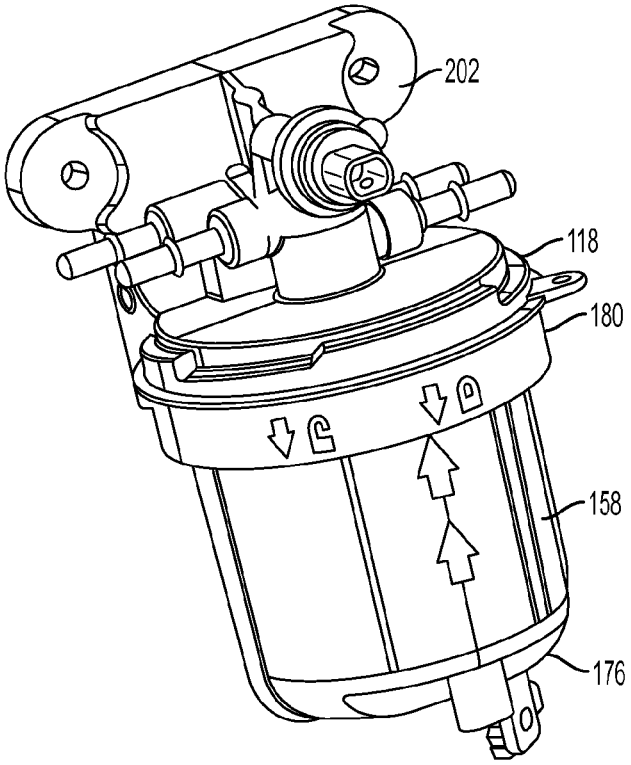
FIG. 5 is a perspective view of a fuel filter in accordance with the present disclosure showing exterior features thereof.
Figure 6:
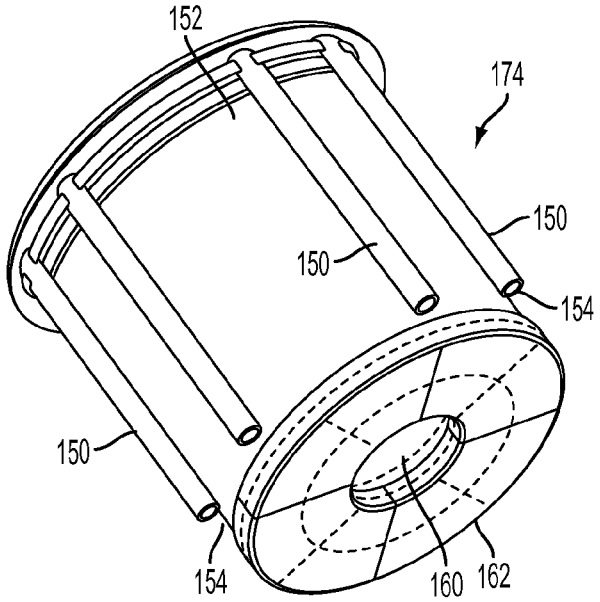
FIG. 6 is a perspective view of an insert that may be configured to fit inside the fuel filter illustrated in FIG. 5.

FIG. 5 is a perspective view of a fuel filter 118 in accordance with the present disclosure showing exterior features thereof including the outside of the container 158. FIG. 6 is a perspective view of an insert 174 that may be configured to fit inside the fuel filter 118 illustrated in FIG. 5. The insert 174 may be configured to fit within the container 158, and may also be configured to at least partially support the filter medium 152 in an annular configuration. The fuel line conduit 160 may be centrally located within and may axially traverse the insert 174. The fuel line conduit may having a fuel line exit port 162 in fluidic communication with the plurality of return fuel line exit ports 154 adjacent a distal end 176 of the container 158. Referring now again to FIGS. 2-4; the insert 174 may form an annular channel outlet 178 radially outside the fuel line conduit 160, and radially inside the filter medium 152.

Various embodiments may include a fuel filter 118 including a container 158, and a filter membrane 152 in the container 158. The fuel filter 118 may also include conduits 150 extending from inlets 153 located adjacent to a first end 180 of the container to outlets 154 located adjacent to a second end 176 of the container 158 to direct two flows of differing temperatures from the first end 180 to the second end 176 to at least partially thermally mix the two flows near the second end 176 before passing a mixed flow through the filter membrane 152.

Referring again to FIG. 1, one of the two flows is a first flow 182, represented with an arrow from a fuel tank 114. Another of the two flows may be a second flow 184, also represented with an arrow, from a recirculation line 120 made relatively warmer than the first flow 182 by heat from one or more engine components, for example the combustion chamber(s) of the internal combustion engine 10, or the fuel rail, or the like, which may be heated indirectly from the heat of combustion. In some cases return flow fuel may be heated via other means, for example by a heater.

The fuel filter 118 may also include an annular manifold 172 located within the first end 180 of the container 158. The annular manifold 172 may be configured to receive a relatively warmer of the two flows. A plurality of conduits 150 may be in fluidic communication with the annular manifold 172. A plurality of outlets 154 may be located on respective ends of each the respective plurality of conduits 150 to mix the relatively warmer flow with the other of the two flows. The fuel filter 118 may include a temperature sensitive valve 170 configured to regulate flow into the manifold 172 from the recirculation line 120.

The container 158 may be substantially cylindrical and may have a central axis 186. The fuel filter 118 may include a substantially cylindrical insert 174 located within the container 158. The insert 174 may include a substantially cylindrical body configured to at least partially support the filter medium 152 in an annular shape. One of the conduits may be a first inlet conduit 160 coupled to a relatively cooler flow. The first inlet conduit 160 may be a tube that may be coaxial with the central axis 186. Another of the conduits 150 may be a plurality of conduits 150 coupled to a relatively warmer flow. The plurality of conduits 150 may be disposed in an annular chamber 188 radially outside the first inlet conduit 160. The plurality of conduits 150 may be arranged in, for example, a circular pattern 190 (FIGS. 3 & 4).

Figure 7:
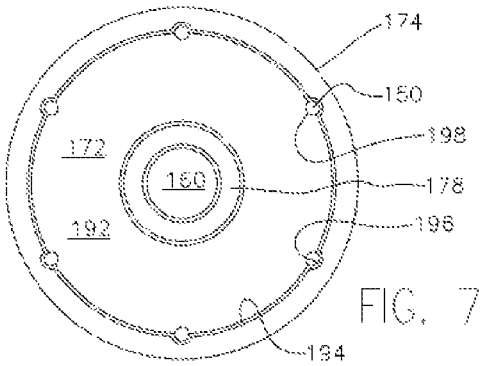
FIG. 7 is a top view of the insert as seen from direction indicated with section line 7-7 in FIG. 2.

FIG. 7 is a top view of the insert 174 as see from direction indicated with section line 7-7 in FIG. 2. The fuel filter 118 may include an annular shaped manifold 172 formed in a top portion of the insert 174. The manifold 172 may include an annular floor 192 and a circumferential wall 194 intersecting a periphery of the floor 192. A plurality of semicircular slots 196 may be formed into the circumferential wall 194. A respective plurality of cooperatively disposed holes 198 may be in the floor, and may provide fluidic access to each respective plurality of conduits 150.

The fuel filter 118 may include an outlet formed as an annular outlet flow channel 178 concentric with and radially outside of the first inlet conduit 160. The filter medium 152 may be an annular filter medium 152 concentric with and radially outside of the annular outlet flow channel 178.

Figure 8:
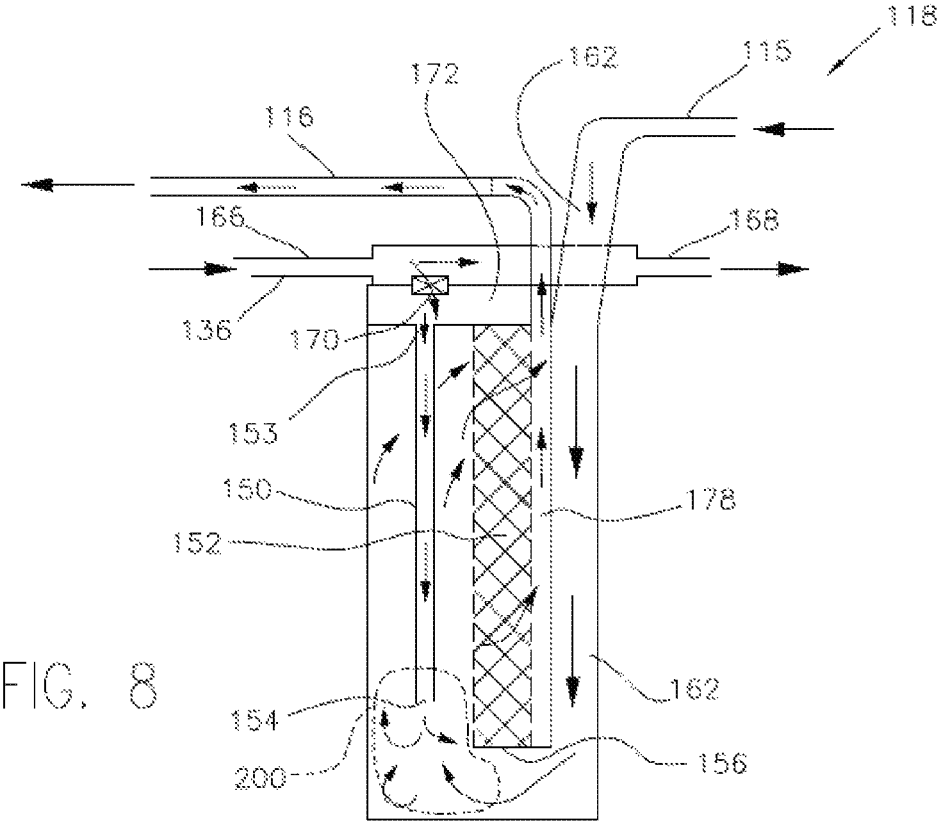
FIG. 8 is a section view illustrating another example fuel filter in accordance with the present disclosure.

FIG. 8 is a section view illustrating another example fuel filter 118 in accordance with the present disclosure. The fuel filter 118 may be used in the system 100 illustrated in FIG. 1. The fuel filter 118 may include a return fuel conduit 150 traversing a filter medium 152. The conduit may include an inlet 153 in fluidic communication with the fuel recirculation passage 120 via, for example the return fuel line 136. The fuel filter 118 may include an outlet 178 downstream from the filter medium 152. The fuel filter 118 may include a substantially rectilinear container 158 disposed to contain a substantially rectilinear filter medium 152.

Referring again to FIG. 1 wherein a system 100 for an internal combustion engine 10 is illustrated. The fuel filter 118 illustrated in FIG. 2, or the fuel filter 118 illustrated in FIG. 8, or one or more similarly configured filters may be included with system 100 in accordance with various embodiments. The system 100 may include a first fuel transport line 115 for transporting fuel from a fuel tank 114. A second fuel transport line 120 may be included for transporting fuel returned from one or more engine components. The system 100 may also include a fuel filter 118. The fuel filter 118 may include a container 158 having a first end 180 and a second end 176. A filter medium 152 may be located inside the container 158. A mixing volume 200 may be located within and near the second end 176 of the container 158 located upstream from the filter medium 152. A first conduit 160 may be coupled to the first fuel transport line 115 near the first end 180 of the container 158, and may have a first outlet port 162 open to the mixing volume 200. A second conduit 150 may be coupled to the second fuel transport line 120 near the first end of the container 158 and having a second outlet port 154 open to the mixing volume 200, shown in rough approximation as a dashed line shape.

The system 100 may include a temperature sensitive valve 170 configured to control a flow of fuel from the second fuel transport line 120 to the second conduit 150. The second conduit 150 may be six individual conduits 150 each fluidically coupled with a manifold 172 located within and adjacent to the first end 180 of the container 158. The six individual conduits 150 may be substantially equally spaced along a circumferential line 190 concentric with a central axis 186 of the container 158 (FIG. 3). The temperature sensitive valve 170 may be configured to control a flow of fuel from the second fuel transport line 120 into the manifold 172.

The system 100 may also include an outlet conduit 178 configured to receive a filtrate from a downstream side of the filter medium 152 formed as an annular flow channel radially inside the filter medium 152, and radially outside the first conduit 160.

The first end 180 of the container 158 may be a top of the container 158. The second end 176 of the container 158 may be a bottom of the container 158. The fuel filter 118 may include a mounting configuration 202 for attaching the container 158 to an inside location of an engine compartment of a vehicle.

The fuel filter 118 may include a water reservoir 204 which may be configured to collect water from the fuel that passes through the filter 118. The water reservoir 204 may include a valve 206 wherein the collected water may be let out from the filter 118. In some cases the fuel filter 118 may be a box filter. In some cases the fuel filter 118 may be substantially cylindrically shaped.

While the depicted example shows a single fuel filter, in alternate embodiments two or more filters may be included. Each filter may receive return fuel from respective recirculation branch passages. In one example, flow through each passage may be regulated by respective thermal recirculation valves. A pressure of fuel at the filter may be communicated to the engine controller 12 by a filter pressure sensor/switch (not shown) positioned at the outlet of the filter.

The specific routines described herein may represent one or more of any number of processing strategies such as event-driven, interrupt-driven, multi-tasking, multi-threading, and the like. As such, various actions, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, functions, or operations may be repeatedly performed depending on the particular strategy being used. Further, the described operations, functions, and/or acts may graphically represent code to be programmed into computer readable storage medium in the control system Further still, it should be understood that the systems and methods described herein are exemplary in nature, and that these specific embodiments or examples are not to be considered in a limiting sense, because numerous variations are contemplated. Accordingly, the present disclosure includes all novel and non-obvious combinations of the various systems and methods disclosed herein, as well as any and all equivalents thereof.

The invention claimed is:

1. A fuel filter comprising:

a plurality of return fuel conduits axially traversing a filter medium, each conduit including an inlet in fluidic communication with a fuel recirculation passage and each having a fuel recirculation passage exit port adjacent to a distal end of the filter medium;

a container for housing the filter medium; and a fuel line conduit axially traversing the filter medium, including an inlet in fluidic communication with a fuel line inlet and a fuel line exit port in fluidic communication with the plurality of fuel recirculation passage exit ports to at least partially mix respective flows from the plurality of return fuel conduits and the fuel line conduit within the container adjacent the distal end of the filter medium.

2. The fuel filter of claim 1, wherein the fuel recirculation passage includes an inlet coupling and an outlet coupling, a temperature sensitive valve operatively disposed between the inlet coupling and the outlet coupling and configured to direct at least part of a flow from the fuel recirculation passage to the plurality of return fuel conduits when a temperature of the flow is within a preselected range.

3. The fuel filter of claim 2, further comprising a manifold formed within the container to receive the flow via the temperature sensitive valve when the temperature of the flow is within the preselected range, the plurality of return fuel conduits being fluidically coupled with the manifold.

4. The fuel filter of claim 1, further comprising:

an insert configured to fit within the container, and to at least partially support the filter medium in an annular configuration;

the fuel line conduit centrally located within and axially traversing the insert; and the insert forming an annular channel outlet radially outside the fuel line conduit and radially inside the filter medium.

5. The fuel filter of claim 1, wherein the plurality of return fuel conduits is six conduits.

6. A fuel filter comprising:

a container;

a filter medium in the container; and conduits extending from inlet couplings located adjacent to a first end of the container to outlets located adjacent to a second end of the container to direct two flows of differing temperatures from the first end to the second end to at least partially thermally mix the two flows near the second end before passing a mixed flow through the filter medium.

7. The fuel filter of claim 6, wherein one of the two flows is a first flow from a fuel tank and another of the two flows is a second flow from a recirculation passage made relatively warmer than the first flow by heat from one or more engine components.

8. The fuel filter of claim 6, further comprising an annular manifold located within the first end of the container and configured to receive a relatively warmer of the two flows, and further comprising a plurality of conduits in fluidic communication with the annular manifold, a plurality of outlets located on respective ends of each the respective plurality of conduits to mix the relatively warmer flow with the other of the two flows.

9. The fuel filter of claim 8, further comprising a temperature sensitive valve configured to regulate flow into the manifold from a recirculation passage.

10. The fuel filter of claim 6, wherein the container is substantially cylindrical and has a central axis, and further comprising:

a substantially cylindrical insert located within the container, the insert including:

a substantially cylindrical body configured to at least partially support the filter medium in an annular shape;

one of the conduits being a first inlet conduit coupled to a relatively cooler flow, the first inlet conduit being a tube coaxial with the central axis; and another of the conduits being a plurality of conduits coupled to a relatively warmer flow, the plurality of conduits disposed in an annular chamber radially outside the first inlet conduit.

11. The fuel filter of claim 10, further comprising an annular shaped manifold formed in a top portion of the insert, the manifold including an annular floor and a circumferential wall intersecting a periphery of the floor, a plurality of semicircular slots formed into the circumferential wall, and a respective plurality of cooperatively disposed holes in the floor providing fluidic access to each respective plurality of conduits.

12. The fuel filter of claim 10, further comprising an outlet formed as an annular outlet flow channel concentric with and radially outside of the first inlet conduit, the filter medium being an annular filter medium concentric with and radially outside of the annular outlet flow channel.

13. A system for an internal combustion engine comprising:

a first fuel transport line for transporting fuel from a fuel tank;

a second fuel transport line for transporting fuel returned from one or more engine components; and a fuel filter including:

a container having a first end and a second end;

a filter medium inside the container;

a mixing volume within and near the second end of the container located upstream from the filter medium;

a first conduit coupled to the first fuel transport line near the first end of the container and having a first outlet port open to the mixing volume; and a second conduit coupled to the second fuel transport line near the first end of the container and having a second outlet port open to the mixing volume.

14. The system of claim 13, further comprising a temperature sensitive valve configured to control a flow of fuel from the second fuel transport line to the second conduit.

15. The system of claim 13, wherein the second conduit is six individual conduits each fluidically coupled with a manifold located within and adjacent to the first end of the container, wherein the six individual conduits are substantially equally spaced along a circumferential line concentric with a central axis of the container.

16. The system of claim 15, further comprising a temperature sensitive valve configured to control a flow of fuel from the second fuel transport line into the manifold.

17. The system of claim 13, further comprising an outlet conduit configured to receive a filtrate from a downstream side of the filter medium formed as an annular flow channel radially inside the filter medium, and radially outside the first conduit.

18. The system of claim 13, wherein the first end of the container is a top of the container and the second end of the container is a bottom of the container.

19. The system of claim 13, further comprising a mounting configuration for attaching the container to an inside location of an engine compartment of a vehicle.

* * * * *